US007072593B2

(12) United States Patent
Negishi

(10) Patent No.: US 7,072,593 B2
(45) Date of Patent: Jul. 4, 2006

(54) METHOD AND APPARATUS FOR PROCESSING IMAGE, IMAGE FORMING APPARATUS, METHOD FOR CONTROLLING IMAGE FORMING APPARATUS, COMPUTER PROGRAM, AND COMPUTER READABLE STORAGE MEDIUM

(75) Inventor: Akira Negishi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/996,309

(22) Filed: Nov. 22, 2004

(65) Prior Publication Data

US 2005/0111857 A1 May 26, 2005

(30) Foreign Application Priority Data

Nov. 26, 2003 (JP) ..... 2003-395850
Oct. 7, 2004 (JP) ..... 2004-294728

(51) Int. Cl.
*G03G 15/00* (2006.01)

(52) U.S. Cl. ..... 399/8; 399/18; 399/45

(58) Field of Classification Search ..... 399/84, 399/45, 393, 8
See application file for complete search history.

(56) References Cited

U.S. PATENT DOCUMENTS 5,414,494 A * 5/1995 Aikens et al. ..... 399/1
6,512,915 B1 * 1/2003 Matsunoshita et al. ..... 399/366
6,577,907 B1 * 6/2003 Czyszczewski et al. ..... 700/17

FOREIGN PATENT DOCUMENTS

JP 2001-121795 A1 5/2001

* cited by examiner

*Primary Examiner*—Arthur T. Grimley
*Assistant Examiner*—Laura K. Roth
(74) *Attorney, Agent, or Firm*—Canon U.S.A. Inc IP Division

(57) ABSTRACT

An image forming apparatus and a method for controlling the same. The image forming apparatus has a keyed sheet storage unit that has a key status of locked and unlocked states. The image forming apparatus can switch operational sequences of the keyed sheet storage unit in response to the key status of the keyed sheet storage unit to achieve ease of use and the enhancement of security level.

31 Claims, 11 Drawing Sheets

| | |
|---|---|
| NAME | TARO YAMADA |
| DATE OF BIRTH | MARCH 3, 1965 |
| SEX | MALE |
| DATE OF BECOMING RESIDENT | MAY 10, 1999 |
| FAMILY RELATIONSHIP | HEAD OF FAMILY |
| NAME OF HEAD OF FAMILY | TARO YAMADA |
| ADDRESS | 3-1-2 KAWAHAMA |
| DATE OF MOVE-IN | MAY 10, 1999 |
| PRIOR ADDRESS | 20-1 SATOMURA, YAMAOKA -SHI, KANAGAWA-KEN |
| PERMANENT ADDRESS | OMITTED |
| HEAD OF FAMILY | OMITTED |
| PLANNED TRANSFER LOCATION | |
| FIRM TRANSFER LOCATION | |
| REMARKS | |

START
ENTER RESIDENT CODE
601
ENTER PASSWORD
602
SEND RESIDENT CODE AND PASSWORD
603
RECEIVE AUTHENTICATION RESULT
604
605
AUTHENTICATED SUCCESSFULLY ?
NO
YES
606
607
ENTER NUMBER OF PRINTS
DISPLAY ERROR
ENTER FEE
608
REQUEST RESIDENT CARD DATA
609
RECEIVE RESIDENT CARD DATA
610
PRINT RESIDENT CARD FROM LOCKED CASSETTE FEEDER
611
END

FIG. 10A

| NAME | SHEET SIZE (SHEET TYPE) | REMAINING PAPER (PERCENTAGE) | STATUS | KEY PROVIDED | KEY STATUS |
|---|---|---|---|---|---|
| CASSETTE 1 | SIZE A3 (STANDARD) | REMAINING (40%) | CLOSED | NO | — |
| CASSETTE 2 | SIZE A4 (SPECIAL) | REMAINING (20%) | CLOSED | NO | — |
| CASSETTE 3 | SIZE A4 (SPECIAL) | REMAINING (100%) | CLOSED | NO | — |
| CASSETTE 4 | SIZE A4 (SPECIAL) | REMAINING (10%) | CLOSED | YES | LOCKED |

1001

FIG. 10B

| NAME | SHEET SIZE (SHEET TYPE) | REMAINING PAPER (PERCENTAGE) | STATUS | KEY PROVIDED | KEY STATUS |
|---|---|---|---|---|---|
| CASSETTE 1 | SIZE A3 (STANDARD) | REMAINING (40%) | CLOSED | NO | — |
| CASSETTE 2 | SIZE A4 (SPECIAL) | REMAINING (20%) | CLOSED | NO | — |
| CASSETTE 3 | SIZE A4 (SPECIAL) | REMAINING (100%) | CLOSED | NO | — |
| CASSETTE 4 | SIZE A4 (SPECIAL) | REMAINING (10%) | CLOSED | YES | UNLOCKED |

1001

FIG. 10C

| NAME | SHEET SIZE (SHEET TYPE) | REMAINING PAPER (PERCENTAGE) | STATUS | KEY PROVIDED | KEY STATUS |
|---|---|---|---|---|---|
| CASSETTE 1 | SIZE A3 (STANDARD) | REMAINING (40%) | CLOSED | NO | — |
| CASSETTE 2 | SIZE A4 (SPECIAL) | REMAINING (20%) | CLOSED | NO | — |
| CASSETTE 3 | SIZE A4 (SPECIAL) | REMAINING (100%) | CLOSED | NO | — |
| CASSETTE 4 | SIZE A4 (SPECIAL) | REMAINING (10%) | CLOSED | YES | LOCKED |
| CASSETTE 5 | SIZE A4 (SPECIAL) | REMAINING (100%) | CLOSED | YES | LOCKED |

1001

FIG. 10D

| NAME | SHEET SIZE (SHEET TYPE) | REMAINING PAPER (PERCENTAGE) | STATUS | KEY PROVIDED | KEY STATUS |
|---|---|---|---|---|---|
| CASSETTE 1 | SIZE A3 (STANDARD) | REMAINING (40%) | CLOSED | NO | — |
| CASSETTE 2 | SIZE A4 (SPECIAL) | REMAINING (20%) | CLOSED | NO | — |
| CASSETTE 3 | SIZE A4 (SPECIAL) | REMAINING (100%) | CLOSED | NO | — |
| CASSETTE 4 | SIZE A4 (SPECIAL) | REMAINING (10%) | CLOSED | YES | LOCKED |
| CASSETTE 5 | SIZE A4 (SPECIAL) | REMAINING (100%) | CLOSED | YES | UNLOCKED |

1001

FIG. 11

STORAGE MEDIUM SUCH AS FD OR CD-ROM

| |
|---|
| |
| FIRST DATA PROCESSING PROGRAM PROGRAM CODE GROUP CORRESPONDING TO STEPS IN FLOWCHART OF FIG. 6 |
| SECOND DATA PROCESSING PROGRAM PROGRAM CODE GROUP CORRESPONDING TO STEPS IN FLOWCHART OF FIG. 9 |
| |

MEMORY MAP OF STORAGE MEDIUM

METHOD AND APPARATUS FOR PROCESSING IMAGE, IMAGE FORMING APPARATUS, METHOD FOR CONTROLLING IMAGE FORMING APPARATUS, COMPUTER PROGRAM, AND COMPUTER READABLE STORAGE MEDIUM

BACKGROUND OF THE INVENTION

1. Field of the Invention

The present invention relates to an image processing apparatus having at least one keyed sheet storage unit, an image processing method, an image forming apparatus, a method for controlling the image forming apparatus, a computer readable program, and a storage medium.

2. Description of the Related Art

Along with e-governance initiatives, a demand for printing a diversity of certificates and local government documents on demand in current printing systems is growing. Some convenience stores are currently providing printing services in one of service quality improvement efforts.

To recognize authenticity of printed matter or master copy of documents, the use of seal impression or watermark to a special sheet of paper is expected in public service.

Radio Frequency Identification system (RFID) is going to be in widespread use as a device that reads and writes information in a non-contact fashion. For example, tiny chips having dimensions of 0.4 mm by 0.4 mm have been developed as such a device. It is contemplated that such a device is mounted on printed matter to manage identification (ID) and prevent counterfeit. It is also contemplated that a sheet having such a tiny RFID chip as a special sheet is printed as one of a diversity of certificates, local government documents, slips, etc.

Known printers and known multi-function apparatuses can print watermarked sheets, RFID attached sheets, and seal impressed sheets using a sheet cassette feeder.

An idea of printing special sheets cannot be implemented without introducing a mechanism that manages the special sheets to prevent forgery.

For example, if a multi-function apparatus is installed in a convenience store, ordinary customers gain an easy access to a sheet cassette feeder, and the above-mentioned application is difficult to implement.

Japanese Patent Laid-Open No. 2001-121795 discloses an apparatus having a keyed sheet cassette feeder.

In the apparatus disclosed in Japanese Patent Laid-Open No. 2001-121795, units in need of protection are merely provided with a key device. The disclosed technique is intended for use in a compact laser beam printer (LBP) having a capacity of a single tray only, typically provided with a sheet cassette feeder having a key device of a minimum cost.

A multi-function apparatus having a plurality of paper cassette feeders with some of the feeders keyed must be uniquely controlled. No techniques performing such control have been proposed.

SUMMARY OF THE INVENTION

The present invention is directed to an image processing apparatus, an image processing method, an image forming apparatus, a method for controlling the image forming apparatus, a computer program, and a computer readable storage medium having stored the computer program.

The present invention is also directed to an image processing apparatus, an image processing method, an image forming apparatus, a method for controlling the image forming apparatus, a computer program, and a computer readable storage medium having stored the computer program for constructing an image processing environment that provides a variety of print services with ease of use and security assured.

The present invention provides a flexible, and easy-to-use printing system appropriate for use in a plurality of operation environments including corporate offices, and local government offices.

According to a first aspect of the present invention, an apparatus operable to process an image, includes: a plurality of sheet feeder units adapted to feed sheets, the plurality of sheet feeder units including at least one keyed sheet feeder unit having a key status; a determining unit adapted to determine the key status of the keyed sheet feeder unit; and a controller controlling the keyed sheet feeder unit to feed the sheets housed therein based on the key status determined by the determining unit.

According to a second aspect of the present invention, a method for controlling an image processing apparatus having a plurality of sheet feeder units adapted to house sheets, the plurality of sheet feeder units including at least one keyed sheet feeder unit having a key status, the method comprising the steps of: determining the key status of the keyed sheet feeder unit; and controlling the keyed sheet feeder unit to feed the sheets responsive to the key status determined in the determining step.

According to a third aspect, the present invention relates to a computer readable storage medium having stored a computer program for causing a computer to perform the image processing method described above.

According to a fourth aspect of the present invention, an apparatus for performing image operations including: a keyed sheet storage unit configured to feed sheets, the keyed sheet storage unit having a key status including locked and unlocked states; a determining unit adapted to determine the key status of the keyed sheet storage unit; and a controller controlling the keyed sheet storage unit to feed the sheets responsive to the determining unit determining that the key status is at least one of the locked state and the unlocked state, wherein the controller inhibits a first image operation performed by the keyed sheet storage unit in the unlocked state responsive to the first image operation being the same as a second image operation using the keyed sheet storage unit in the locked state.

According to a fifth aspect of the present invention, a method for controlling an image forming apparatus having a keyed sheet storage unit having locked and unlocked states, includes: a step of permitting performance of a first operation by the keyed sheet storage unit to be used in the locked state thereof, a step of permitting performance of a second operation by the keyed sheet storage unit to be used in the unlocked state thereof, and a step of inhibiting the performance of the second operation by the keyed sheet storage unit in the unlocked state if the second operation is the same as the first operation by the keyed sheet storage unit in the locked state.

According to a sixth aspect, the present invention relates to a computer readable storage medium having stored a computer program for performing the image forming method according to the fifth aspect. In accordance with the present invention, the information processing apparatus having the keyed sheet storage unit is used regardless of whether the keyed sheet storage unit is locked or unlocked. The image processing apparatus is operated in different sequences, one sequence with the keyed sheet storage unit locked and the other with the keyed sheet storage unit unlocked. The image processing apparatus provides a variety of print services with the ease of use and security assured. The present invention thus provides convenient apparatus and system providing operational flexibility and the ease of use in each of a plurality application environments including corporate offices, local government offices, etc.

Further features and advantages of the present invention will become apparent from the following description of the embodiments with reference to the attached drawings.

BRIEF DESCRIPTION OF THE DRAWINGS

FIGS. 10A–D illustrate a control process example in accordance with an embodiment of the present invention.

FIG. 11 is a memory map of a storage medium storing data processing programs readable by the image processing system of an embodiment of the present invention.

DESCRIPTION OF THE EMBODIMENTS

First Embodiment

Figure 1:
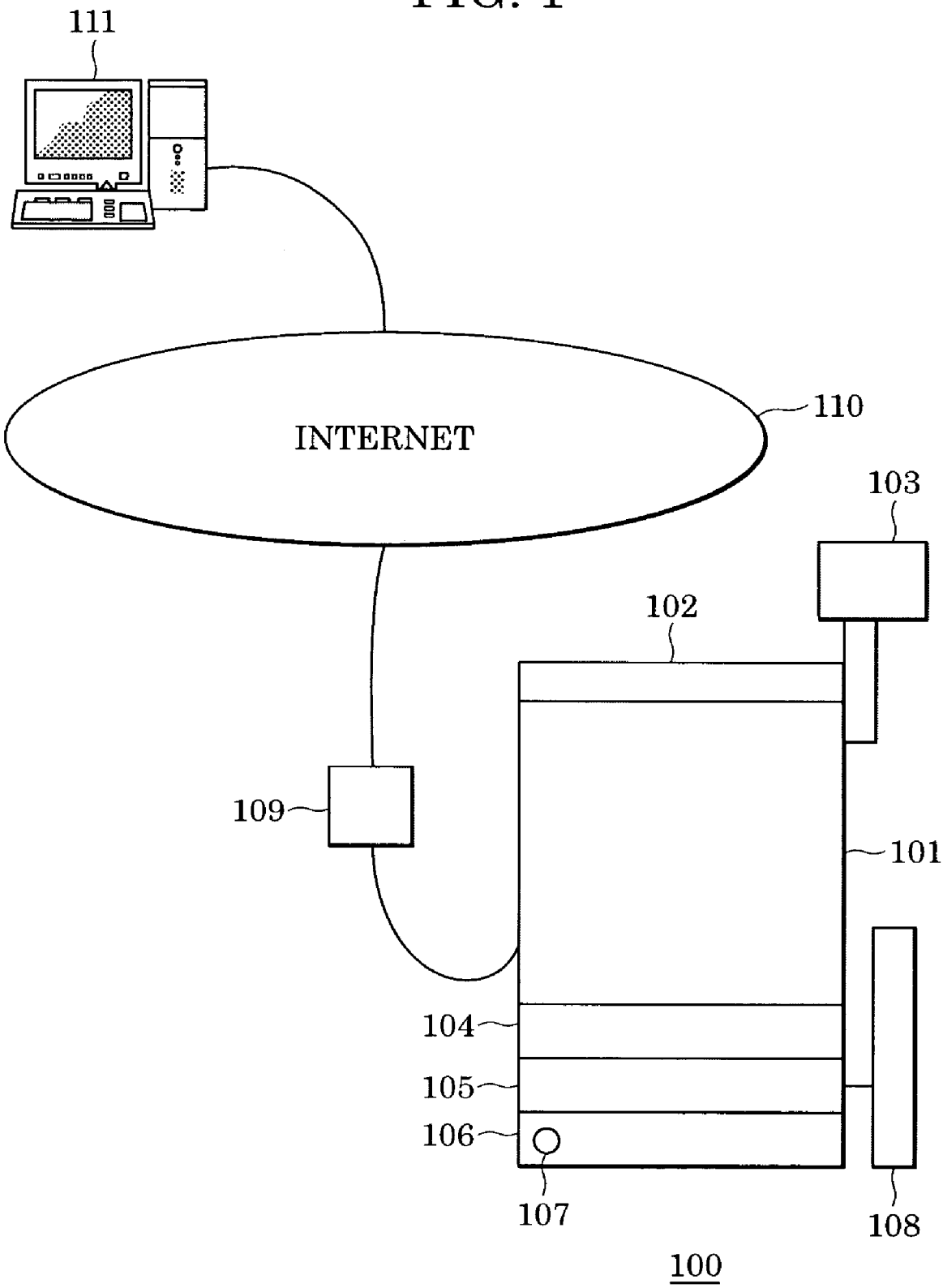
FIG. 1 is a schematic diagram of an image processing system in accordance with a first embodiment of the present invention.

The embodiments of the present invention are described below. FIG. 1 is a schematic diagram illustrating an image processing system (also referred to as an image forming system) in accordance with a first embodiment of the present invention.

As shown in FIG. 1, a color copying apparatus 100 is one example of the image processing apparatus (also referred to image forming apparatus). A printer 101, communicating with a scanner 102, prints a color image. The color copying apparatus 100, connected to a network, has a function of printing resident cards, and may be installed in a convenience store, for example.

The scanner 102 scans an original image, and transmits the data of the original image to the printer 101 for color printing.

An operation unit 103 is a liquid-crystal monitor serving as a touch panel. A user performs a variety of operations to the color copying apparatus 100 using the operation unit 103. Standard keyless sheet cassette feeders 104 and 105 are used for copying and printing in the color copying apparatus 100. A keyed (or key-lockable) sheet cassette feeder 106 has a key 107 so that ordinary users may not replenish special recording media. The key 107 is locked so that the keyed sheet cassette feeder 106 may not be pulled out of the apparatus body of the color copying apparatus 100.

A coin box 108 receives coins deposited by a user who pays a fee for a copy service or a print service performed by the color copying apparatus 100.

An asymmetric digital subscriber line (ADSL) 109 is used to connect the color copying apparatus 100 to the Internet 110. A resident card server 111 is connected to a communication medium, such as the Internet 110. The information source of the resident card server 111 is managed by a local government. A resident at a convenience store operates the operation unit 103 of the color copying apparatus 100 to enter resident card data in response to a certificate request operation guide for the issue of a resident card.

By operating the color copying apparatus 100 at the convenience store and paying the fee, each resident enjoys a public service of receiving a printed resident card.

Figure 2:
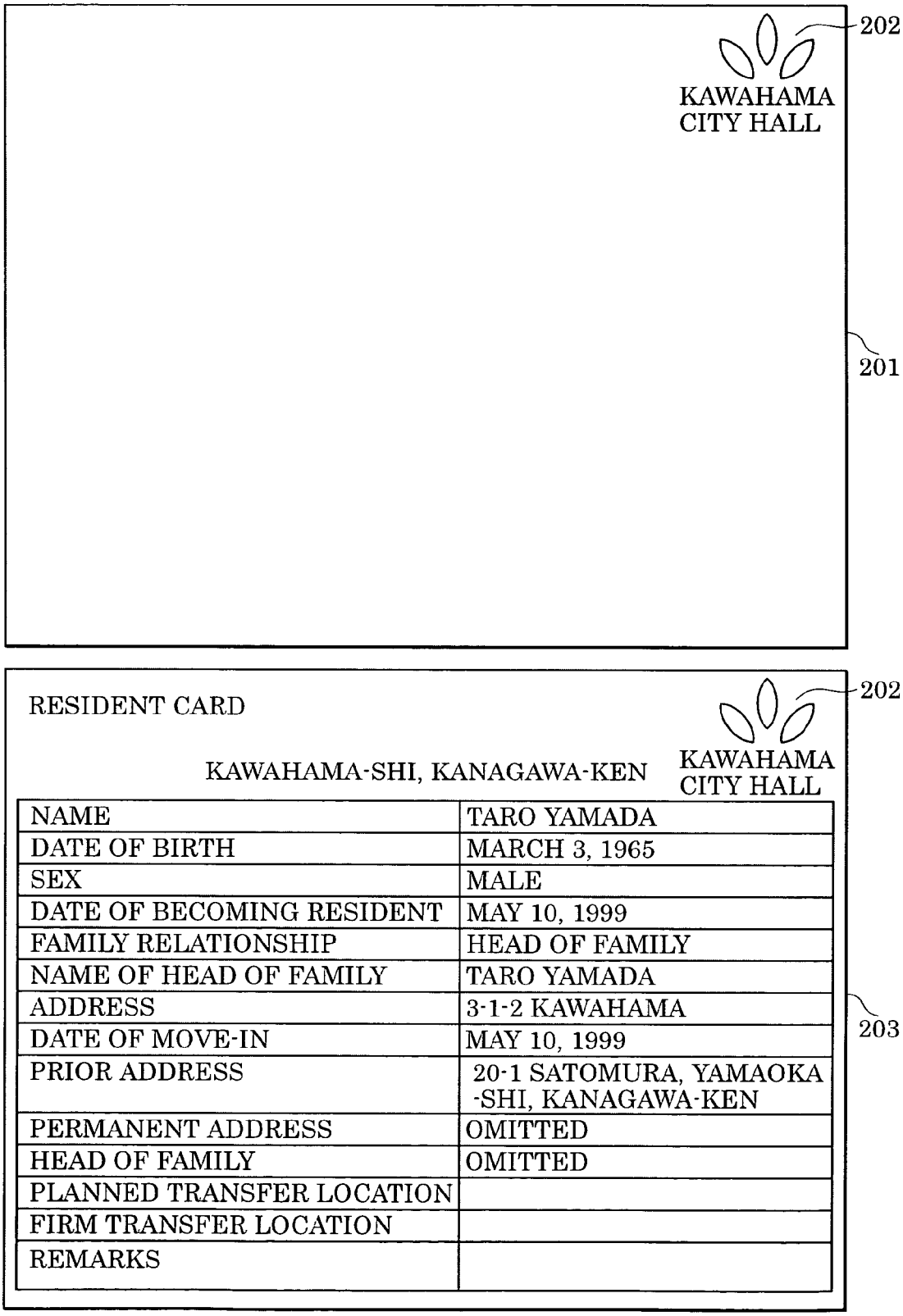
FIG. 2 illustrates a particular recording medium held in a keyed sheet cassette feeder shown in FIG. 1 and a printout result of the medium.

FIG. 2 illustrates a special recording medium held in the keyed sheet cassette feeder 106 shown in FIG. 1 and the printout result of the medium. For example, the special recording medium is watermarked beforehand.

As shown in FIG. 2, a sheet (special recording medium) 201 is used for resident card printing. The sheet 201 has a watermark 202 at a predetermined location thereof. Only an authorized person can unlock the key 107 to replenish the sheet 201 in the keyed sheet cassette feeder 106.

The printer 101 prints resident data received from the resident card server 111 on the sheet 201 having the watermark 202, thereby outputting a resident card printout 203. The layout of resident data on the resident card printout 203 can differ from public entity to public entity.

The resident card printout 203, with the watermark 202 at the upper right corner thereof, assures authenticity of the sheet and master copy of the resident card. The resident card printout 203, different from ordinary copied document, functions as a notarial document.

The sheets 201 must be controlled so that the sheets 201 are not used for any purposes other than intended one. In accordance with the first embodiment, a bundle of watermarked sheets 201 is set in the keyed sheet cassette feeder 106 of the color copying apparatus 100, and may be replenished only by a person in charge in the local government.

Figure 3:
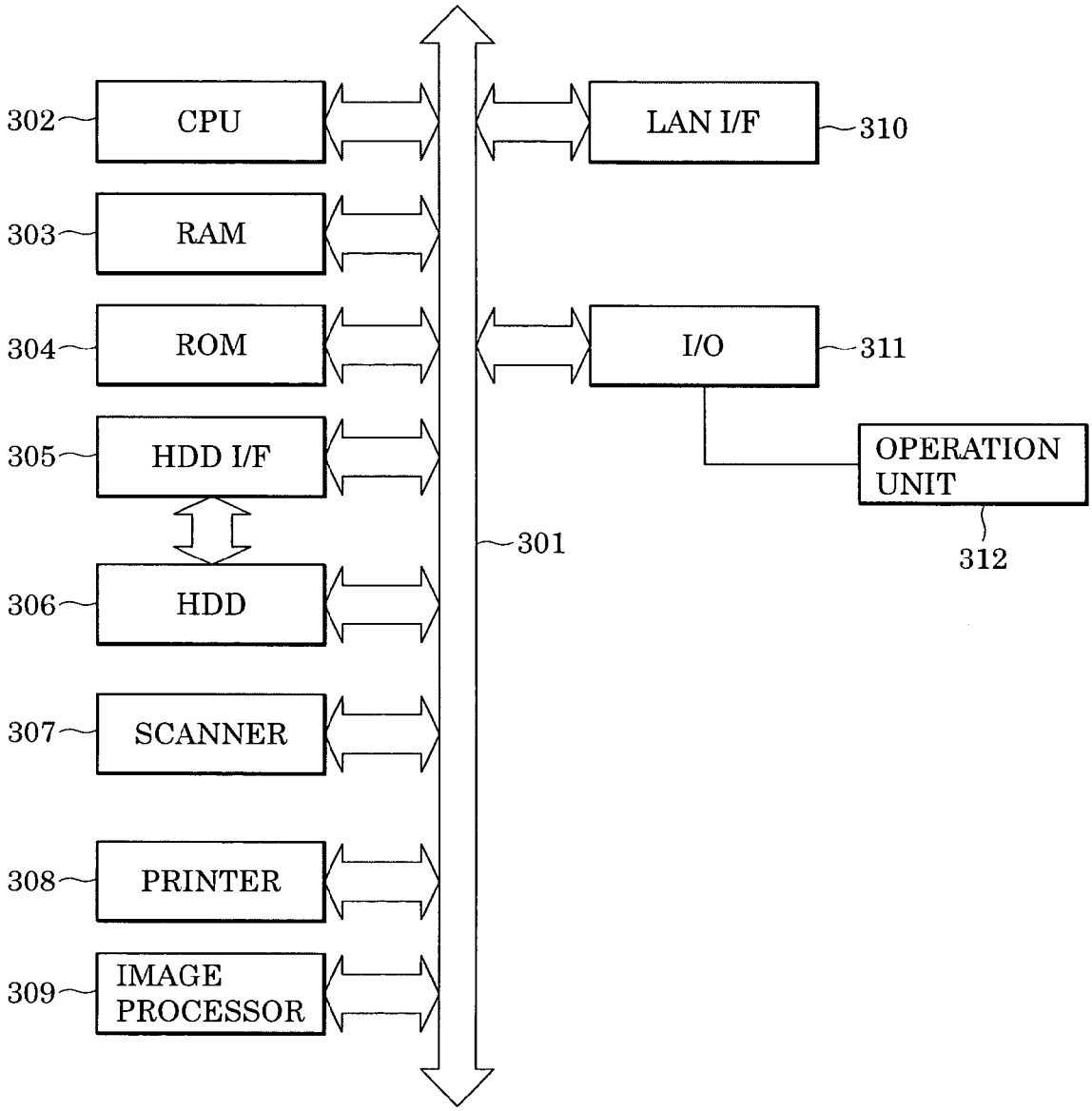
FIG. 3 is a block diagram illustrating a color copying apparatus of FIG. 1.

FIG. 3 is a block diagram illustrating the color copying apparatus 100 of FIG. 1.

As shown in FIG. 3, a central processing unit (CPU) 302 loads, to a random-access memory (RAM) 303, a variety of control programs, including a boot program for startup, from a read-only memory (ROM) 304, and generally controls devices connected to a CPU bus 301. The RAM 303 serves as a frame buffer for scan image data and print image data, and as a work area for system operation.

A hard disk drive (HDD) interface (I/F) 305 writes data to and reads data from a hard disk 306. The hard disk 306 stores system software programs and scan image data. A scanner 307 includes a charge-coupled device (CCD) sensor and a halogen lamp.

A printer 308 is an electrophotographic color printer. An image processor 309 performs, on image data scanned and captured by the scanner 307, image processing including gamma correction, calibration, color space conversion, using application specific ICs (ASICs).

A local-area network (LAN) I/F 310 is connected to a LAN via Ethernet® based 100BaseT/10BaseT. An input/output (I/O) controller 311, connected to an operation unit 312, performs display processing (user interface process) to an liquid-crystal display of the operation unit 312, and transfers inputs from a touch panel and mechanical buttons on the operation unit 312 to the CPU 302.

The color copying apparatus 100 thus constructed receives a job written in PostScript or portable document format (PDF) from a data processing apparatus (including the resident card server 111 of FIG. 1) in a predetermined protocol through the LAN I/F 310, and stores the job in the RAM 303. The CPU 302 converts the PostScript data into a raster image, and stores the raster image in a frame buffer in the RAM 303. The raster image is then read from the frame buffer in the RAM 303 and outputted to the printer 308 for printing. An image is thus printed on a variety of supplied recording media. The raster image is repeatedly printed on the recording medium on a per print data basis, namely, in the order of MCYK (magenta, cyan, yellow, and black) to form a full-color image.

The printer 308 functions as a network printer as described above. In this public service printing process, namely, a resident card issuance service in accordance with the first embodiment, the resident data in a PDF file format is received from the resident card server 111 via the Internet 110 under the control of a control program stored in the hard disk 306 and rasterized on the RAM 303 for printing. The printing process will be described below.

Figure 4A:
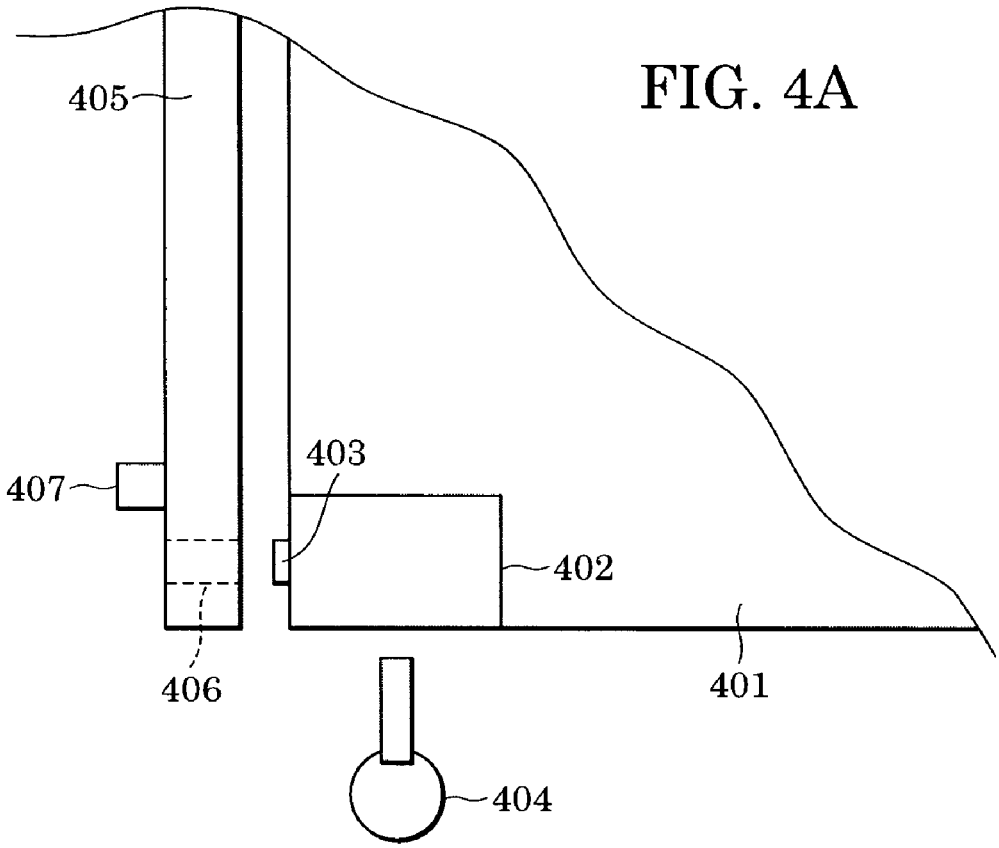
FIGS. 4A and 4B are sectional views of a lock and unlock mechanism of a key of the keyed cassette feeder in the color copying apparatus of FIG. 1.
Figure 4B:
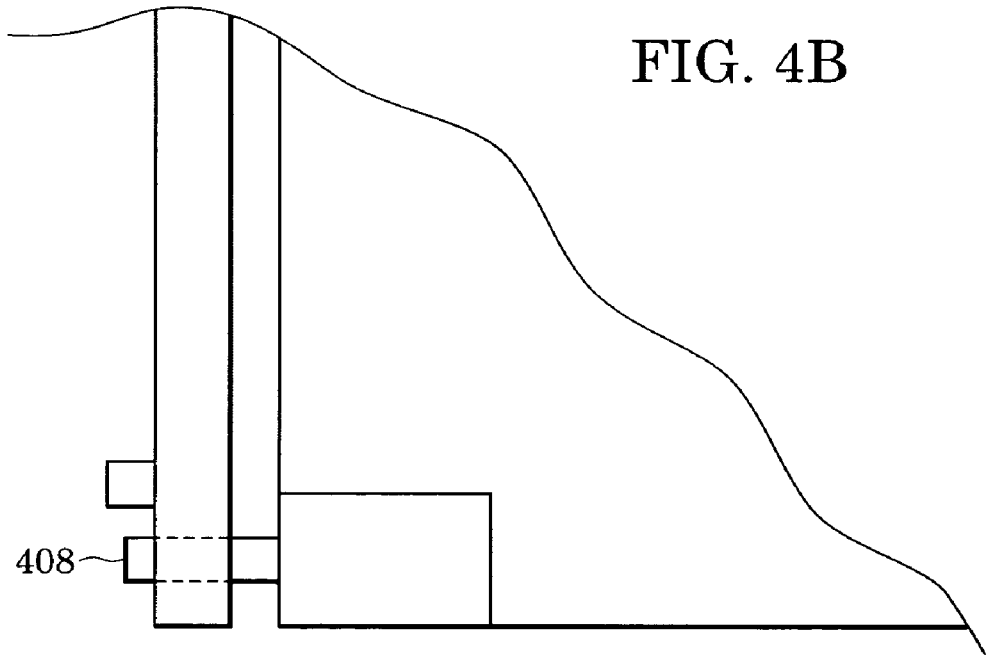

FIGS. 4A and 4B are top views of a locking and unlocking mechanism of the key 107 in the keyed sheet cassette feeder 106 in the color copying apparatus 100. The left front corner portion of a topside 401 of the keyed sheet cassette feeder 106 of FIG. 1 is here viewed from above in the installed position of the color copying apparatus 100. FIG. 4A illustrates the key 107 in the unlocked state thereof, and FIG. 4B illustrates the key 107 in the locked state thereof.

A key unit 402 of FIGS. 4A and 4B corresponds to the key 107 of FIG. 1. FIGS. 4A and 4B show a key 404 for the key unit 402 and a lock bar 403 that is projected and retracted in response to the operation of the key 404. A metal plate 405 is a portion of a guide, of the keyed sheet cassette feeder 106, fixed to the casing of the color copying apparatus 100. The metal plate 405 has a hole 406 with which the lock bar 403 of the key unit 402 is engaged. A sensor 407 is mounted on the metal plate 405 to detect whether the keyed sheet cassette feeder 106 is locked or unlocked.

By inserting the key 404 into a keyhole (not shown) on the front face of the key unit 402 and then turning the key 404, the lock bar 403 passes through the hole 406 of the metal plate 405, and is projected to a locked position 408 and stops there. The lock bar 403 holds and prevents a keyed sheet cassette feeder 401 from being pulled out.

The lock bar 403 returns to a retracted position by inserting the key 404 into the keyhole in the front of the key unit 402 and turning in the reverse direction. The keyed sheet cassette feeder 401 is unlocked and ready to be pulled out.

Figure 5A:
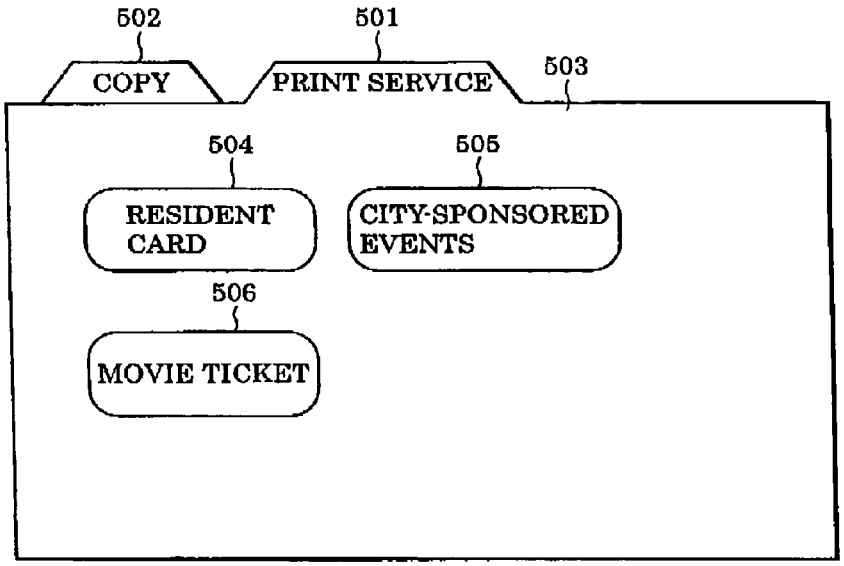
FIGS. 5A and 5B illustrate a print service menu screen displayed on an operation unit of FIG. 3.
Figure 5B:
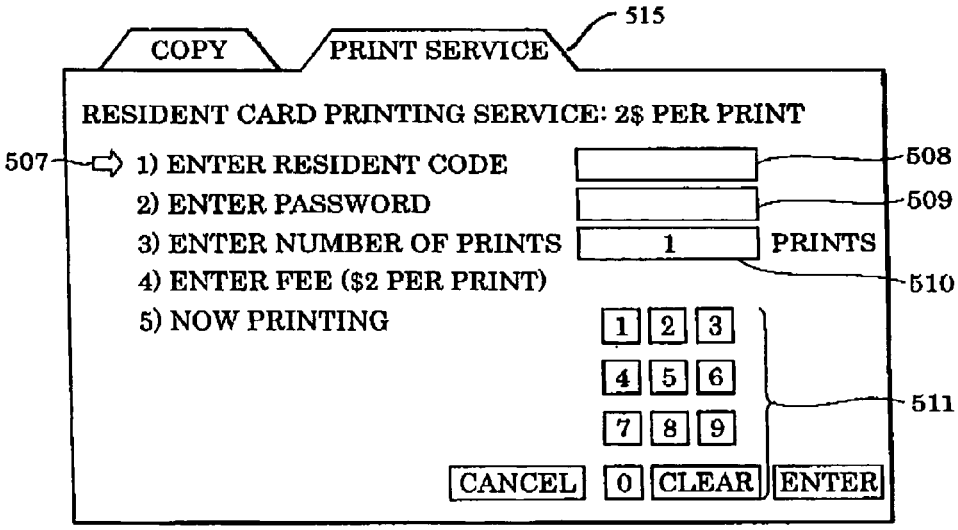

FIGS. 5A and 5B illustrate print service menu screens displayed on the operation unit 312 of FIG. 3. In accordance with the first embodiment, a setting operation is performed by selecting between a standard copy service and a print service with tabs. The screen switching control in response to the tab selection is performed by the CPU 302.

As shown in FIGS. 5A and 5B, a print service tab 501 and a copy tab 502 are provided. By directly touching the touch panel of the operation unit 312 with a finger tip, the user can switch the screen. FIG. 5A illustrates a top screen 503 for the print service.

Menu buttons 504–506 for the print service provided by the color copying apparatus 100 are arranged on the top screen 503. The button 504 is used to perform resident card printing featured by the present invention, the button 505 is used to retrieve information relating to events conducted by the local government, and the button 506 is used to purchase a movie ticket.

If the resident card print button 504 is selected on the print service screen of FIG. 5A, the CPU 302 switches to a resident card print screen 515. The resident card print screen 515 is registered as UI data in the hard disk 306. In response to the selection of the resident card print button 504, the resident card print screen 515 is read from the hard disk 306 and displayed on the operation unit 312.

The resident card printing and the procedure thereof are displayed as shown in FIG. 5B. A cursor 507 shows an operation phase of the resident card printing.

The user enters a resident code in an area 508 in accordance with the displayed procedure. Instead of the cursor 507 that guides the user for code inputting, a different cursor (not shown) may be displayed to point to the area 508.

The user enters a code the local government assigns to each resident. Numeric keys, CANCEL, CLEAR, and ENTER buttons are displayed on the bottom right portion of the resident card print screen 515. To cancel input data, the CANCEL button is pressed. The ENTER button is pressed when data inputting is complete. To cancel a series of steps for the resident card print process, the CANCEL button is selected. In response to the selection of the CANCEL button, the top screen 503 of the print service appears.

When the resident code is input, the cursor 507 shifts down to prompt the user to enter a password in a next input step. The user is authenticated by entering a predetermined password in an area 509 corresponding to the resident code. The numeric keys 511 are also used to enter the password.

Subsequent to the entering of the password, the cursor 507 shifts down to enter the number of prints in the area 510. The default value of the number of prints is "1". The number of prints can be set within a range from 1 to 20 using the numeric keys 511.

When the number of prints is entered, the cursor 507 further shifts down. The user is prompted to enter a fee calculated by a payment process (not shown), here $2.00, into the coin box 108.

If the CPU 302 determines that the calculated fee with $2.00 per print has been entered into the coin box 108, the cursor 507 shifts down further. The printing of the resident card now starts.

Optionally, a voice guidance corresponding to the content pointed by the cursor 507 may be outputted from a loudspeaker (not shown). This arrangement is intended for people who have difficulty seeing the on-screen instructions.

Figure 6:
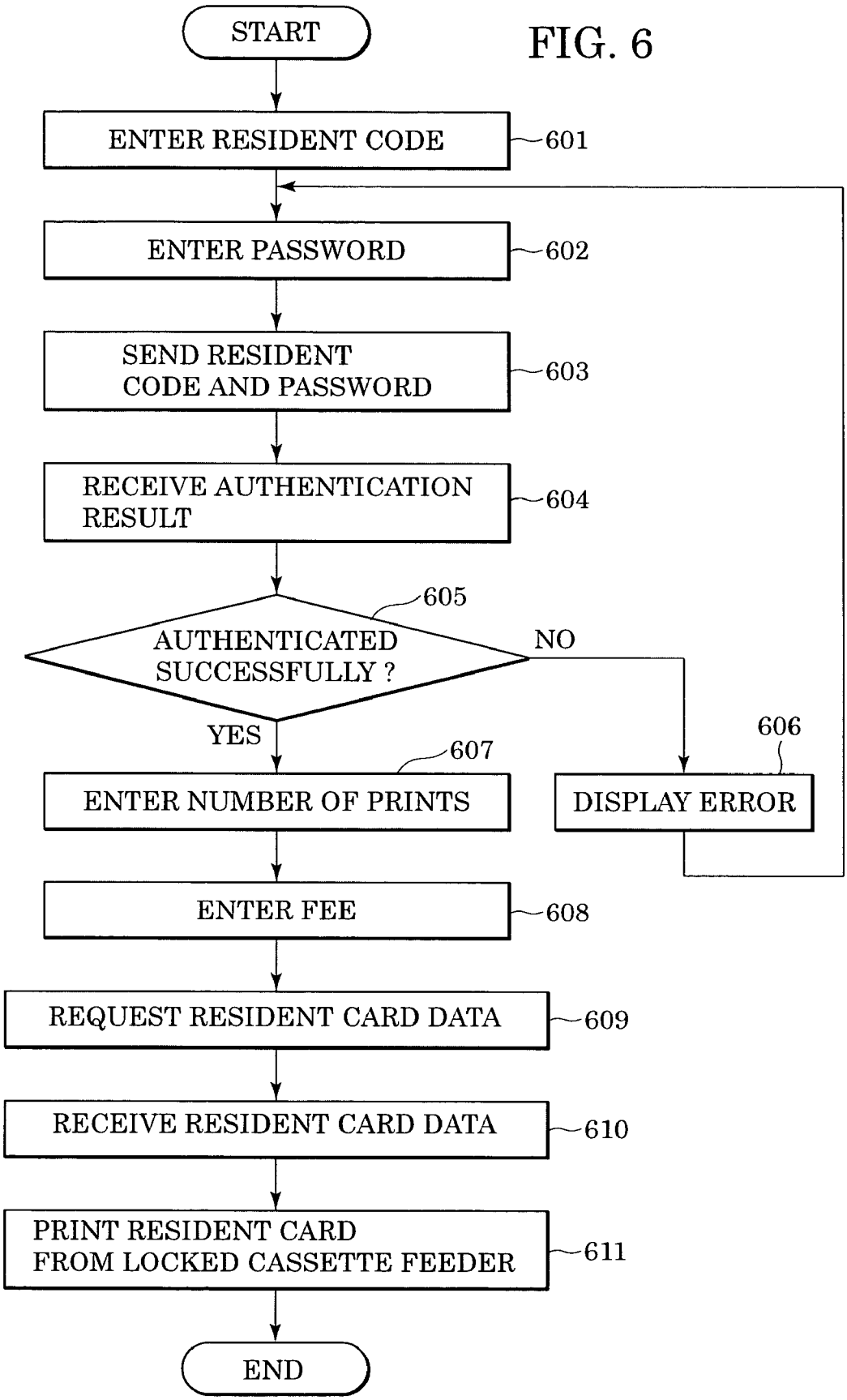
FIG. 6 is a flowchart of a first data processing procedure of an image processing apparatus in accordance with an embodiment of the present invention.

FIG. 6 is a flowchart of a first data processing procedure of the color copying apparatus 100 of the first embodiment. To perform this procedure, namely, the resident card print process, the CPU 302 loads a control program from one of the ROM 304 and the hard disk 306 to the RAM 303.

In step 601, the user enters the resident code on the screen of FIG. 5B on the operation unit 312. In step 602, the user enters the password using the numeric keys 611.

In step 603, the CPU 302 transmits the resident code and the password in an encrypted form thereof to the resident card server 111 via the Internet 110.

The resident card server 111 checks the resident code and the password against the database of the city main register for authentication. The authentication result is transmitted to the requesting color copying apparatus 100 via the Internet 110.

In step 604, the CPU 302 receives the authentication result from the resident card server 111. The CPU 302 determines whether the user is successfully authenticated in step 605. If the user is not successfully authenticated, the operation unit 312 displays an authentication error on the LCD thereof in step 606, and the process returns to step 602.

If the number of returns exceeds a set value, or the authentication process is repeated on different days at different times, the history of such actions is recorded. Optionally, the CPU 302 determines whether or not the print request by the user is innocent, and notified the resident card server 111 of the determination result.

If the user is successfully authenticated in step 605, the user enters a required number of prints in step 607. A warning message is displayed if the entered number of prints is above the upper limit.

The user enters/deposits the fee into the coin box 108 in step 608. The CPU 302 controls the detection of the fee to detect whether the predetermined fee is received in the coin box 108. If the CPU 302 determines that the correct fee is received, the color copying apparatus 100 transmits information of the amount of fee and the number of prints via the Internet 110, thereby requesting the resident card server 111 to acquire the resident data (step 609).

In response to the acquisition request from the color copying apparatus 100, the resident card server 111 checks the amount of fee and the number of prints, searches the database for the resident data of the resident code, retrieves the resident data, and then transmits the resident data in a PDF format.

In step 610, the color copying apparatus 100 receives the resident data from the resident card server 111. In step 611, the CPU 302 rasterizes the resident data in the PDF format on the RAM 303. The CPU 302 selects the keyed sheet cassette feeder 106 as a feeder of the sheet 201 with the watermark 202, and feeds the sheet 201 of FIG. 2 from the keyed sheet cassette feeder 106 for printing.

The first embodiment has been discussed with reference to the resident card print service. The present invention is also applicable to a print process for other local government documents, certificates, and valuable papers.

In accordance with the first embodiment, the individual authentication is performed using the password. Alternatively, other authentication techniques including fingerprint authentication and biometric authentication may be used. Furthermore, each of the fingerprint authentication and the biometric authentication may be combined with the password authentication.

In accordance with the first embodiment, the resident data received from the resident card server 111 is printed on the sheet 201 having the watermark 202. When the resident card server 111 transmits the resident data, management information unique to the user (the unique information may be generated by combining a predetermined random number with the name of the user and a management number of the user) may be transmitted together. The unique information is then printed together with the resident data. The resident card server 111 may attach the management number to the history of the resident data as individual information and manages and stores the management number for next possible printing until a set time limit has elapsed.

Figure 7:
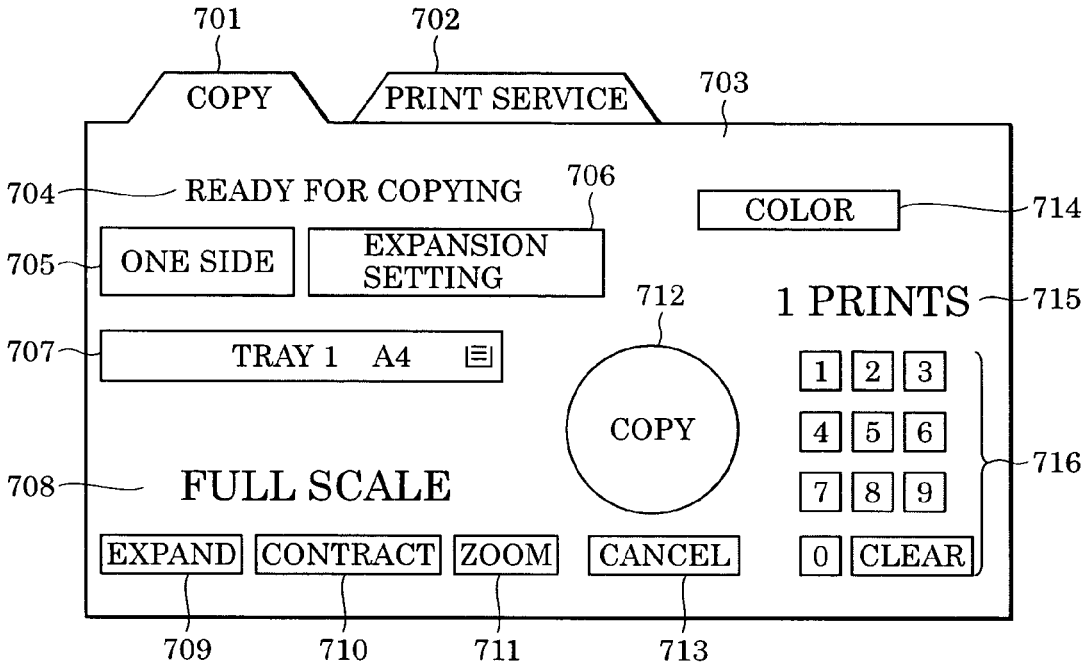
FIG. 7 illustrates a copy menu screen displayed on the operation unit of FIG. 3.

FIG. 7 illustrates a copy menu screen displayed on the operation unit 312 of FIG. 3. In accordance with the first embodiment, the color copying apparatus 100 switches between a standard copy service and a print service by selecting the corresponding tag. The screen switching control is performed by the CPU 302. When the user selects the copy tab 502 of FIG. 5A, the CPU 302 switches to a copy setting screen of FIG. 7.

As shown in FIG. 7, a copy tab 701 and a print service tab 702 are available. By selecting each tab, the screen below the tap is changed in content. A standard copy screen 703 is shown in FIG. 7.

A status message 704 shows the status of the color copying apparatus 100, reading here "ready for copying." A both side print setting button 705 is used to switch to a both-side printing mode from a one side printing mode. As shown in FIG. 7, the one side printing mode is now selected.

An expansion setting button 706 is also available. With the expansion setting button 706 selected, a sub menu is displayed to enter a variety of settings including color adjustment. A tray selection button 707 is used to select a tray. The selected tray, sheet size, and the remaining amount of sheets are displayed.

A scale display area 708 displays a scale of the printing. Each time one of an expand button 709, a contract button 710, and a zoom button 711 is selected, the display in the scale display area 708 changes accordingly. A copy button 712 is used to start the copy process. A cancel button 713 is used to stop the copy process.

A color mode setting button 714 is used to switch between a color mode and a monochrome mode. The number of prints is set referring to a print count display area 715. The number of prints can be set within a range from 1 to 999 prints using numeric keys 716.

Figure 8:
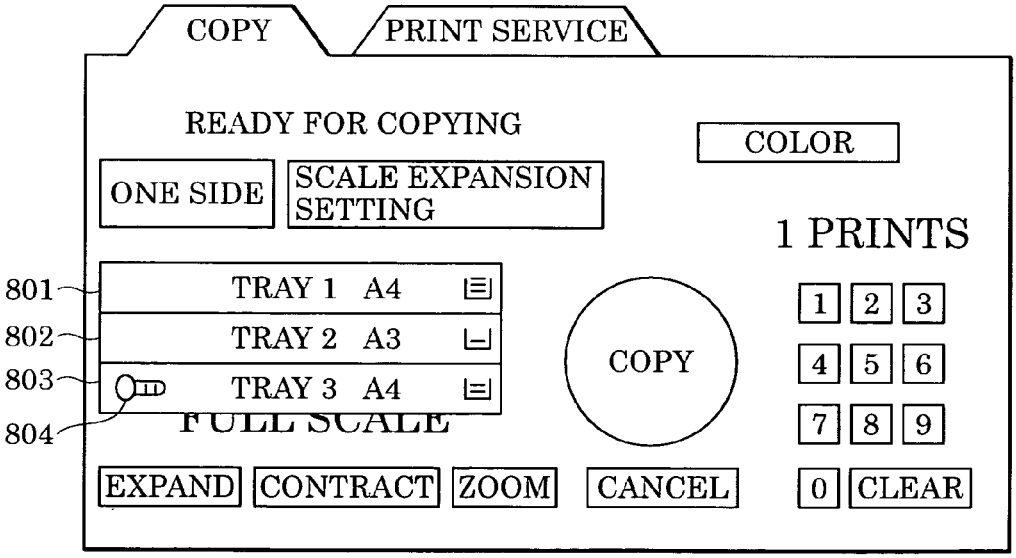
FIG. 8 illustrates a major portion of the copy menu screen of FIG. 7.

FIG. 8 illustrates a major portion of the copy menu screen displayed on the operation unit 312 shown in FIG. 7. The screen of FIG. 8 appears when the tray selection button 707 is selected on the screen of FIG. 7.

When the tray selection button 707 is selected on the screen of FIG. 7, the CPU 302 performs a control process to display sheet feeder trays 801–803 usable in the color copying apparatus 100, the sheet sizes thereof, and the remaining amount of sheets thereof.

A desired feeder tray is selected by selecting the desired feeder tray. Shown here are a tray 1 for sheet size A4 (sheet feeder tray 801), a tray 2 for sheet size A3 (sheet feeder tray 802), and a tray 3 for sheet size A4 (sheet feeder tray 803). The sheet feeder tray 803 is a keyed tray. Since the sheet feeder tray 803 is currently locked, it is annotated with a key icon 804. The display of the tray and sheet size is grayed out to show that the sheet feeder tray 803 cannot be selected.

In accordance with the first embodiment, the keyed sheet cassette feeder in the locked state thereof cannot be selected for copying.

This arrangement prevents the keyed sheet cassette feeder from feeding special application sheets in a careless manner.

The icon visibly and distinctly shows whether the keyed sheet cassette feeder is locked or unlocked in the first embodiment, and the keyed sheet cassette feeder in the unlocked state thereof is used in the same manner as a keyless sheet cassette feeder. Depending on the application of the color copying apparatus 100, the keyed sheet cassette feeder may be retrained in usage or may be used as a keyless sheet cassette feeder.

In accordance with the first embodiment, the keyed sheet cassette feeder in the locked state thereof is grayed out. Alternatively, keeping the keyed sheet cassette feeder undisplayed is also acceptable.

Second Embodiment

In accordance with the first embodiment, the resident data acquired from the resident card server 111 is printed on the sheet 201 having the watermark 202 supplied from the keyed sheet cassette feeder 106. If a sheet from the keyed sheet cassette feeder 106 is jammed, an unauthorized user cannot perform a jam recovery process. A particular administrator must be notified of the occurrence of paper jamming to recover the color copying apparatus 100. The notification process and jam recovery process are described below.

The color copying apparatus 100 of FIG. 3 further includes a mail client function. In accordance with setting, the color copying apparatus 100 can transmit management information to a mail address registered in the hard disk 306, such as an administrator (including a personal computer, a cellular phone, and a mobile terminal).

Figure 9:
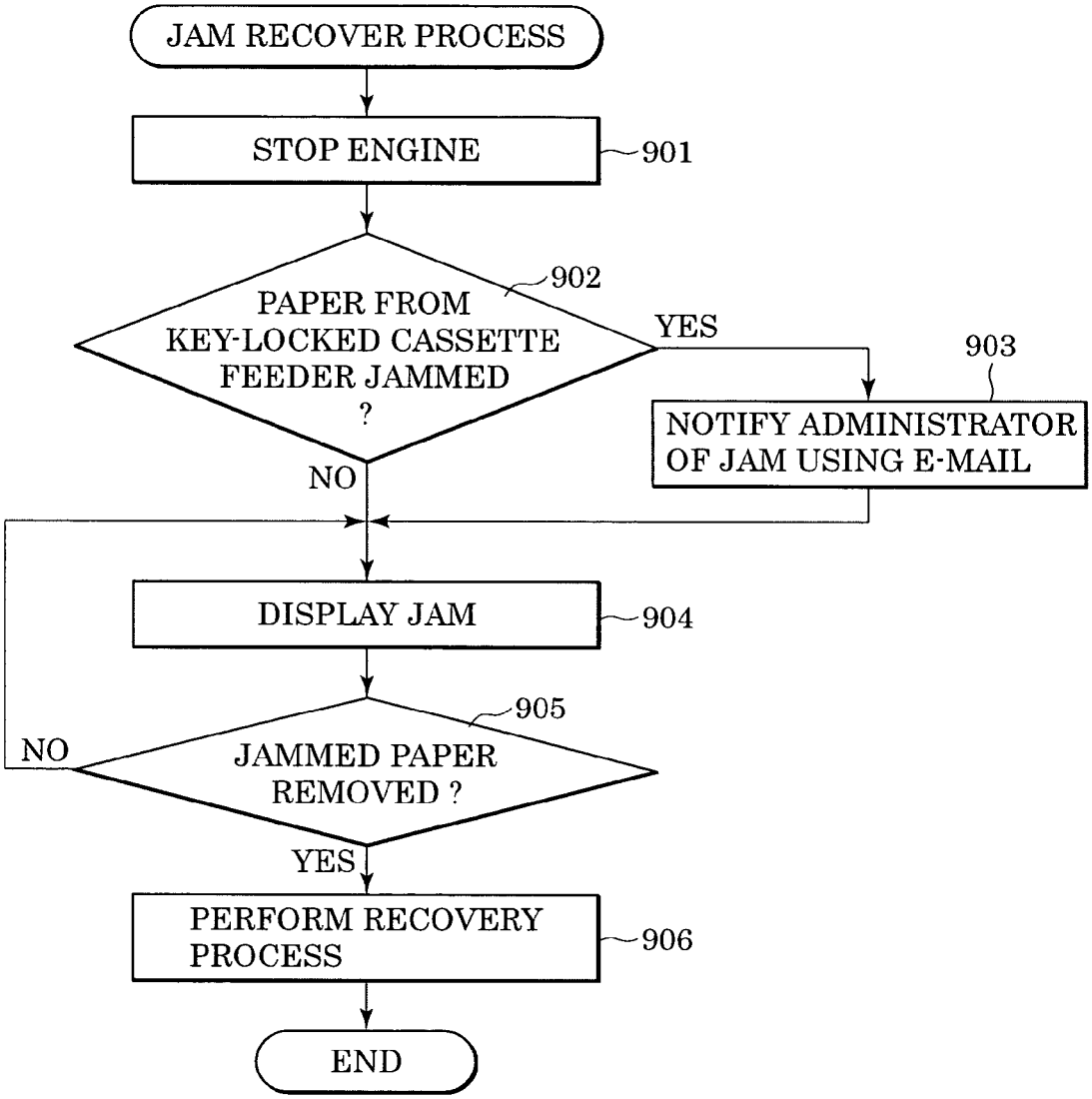
FIG. 9 is a flowchart of a second data processing procedure of the image processing apparatus in accordance with an embodiment of the present invention.

FIG. 9 is a flowchart illustrating a second data processing procedure of the color copying apparatus 100 in accordance with a second embodiment of the present invention. To perform the second data processing procedure, namely, a jam recovery step in the resident card print process, the CPU 302 loads a control program from one of the ROM 304 and the hard disk 306 to the RAM 303.

Upon detecting an occurrence of paper jamming in the color copying apparatus 100, the CPU 302 forces the printer 308 to stop the operation thereof in step 901. In step 902, the CPU 302 determines whether a sheet fed from the keyed sheet cassette feeder 106 in the locked state thereof is jammed. If no in step 902, processing proceeds to step 904.

If yes in step 902, processing proceeds to step 903 where the CPU 302 uses the e-main function to notify an administrator that the sheet is jammed. Processing proceeds to step 904.

In step 904, the CPU 302 displays, on the operation unit 103 of the color copying apparatus 100, a screen indicating the location of paper jamming and for prompting the user to remove the jammed sheets. In step 905, the CPU 302 waits on standby until the jammed sheet is removed.

If the CPU 302 determines that the jammed sheet has been removed, a recovery process is performed in step 906. Processing thus ends.

The copying operation or the print operation resumes starting from the point of jamming.

In accordance with the second embodiment, the remaining amount of sheets in each cassette feeder is detected as previously discussed with reference to the operation unit 312. If the CPU 302 detects that the remaining amount of sheets in the keyed sheet cassette feeder 106 in the locked state thereof is low, the administrator may be requested to replenish sheets.

Upon detecting the shifting of the keyed sheet cassette feeder 106 from the locked state to the unlocked state, the CPU 302 may notify the administrator of the shift via an e-mail alarm.

In the second embodiment, the e-mail is used to notify the administrator of various information. Alternatively, telephone, pager, or any other means may be used.

Print service for printing local government documents and certificates on the special sheets having the watermark is provided in convenience stores or public locations such as a city hall.

Third Embodiment

In accordance with the first embodiment, the resident data acquired from the resident card server 111 is printed on the sheet 201 having the watermark 202 supplied from the keyed sheet cassette feeder 106. The sheet 201 can be perforated along a line that delineates a resident card section from the remaining section of the sheet 201. The resident card section is thus separated from the remaining section of the sheet 201. Other information, such as a receipt, may be printed on the remaining section.

In the preceding embodiments, the resident code and the password are transmitted to the resident card server 111 when the resident code is entered via the operation unit 312. The key (or lock) status of the keyed sheet cassette feeder can be determined, and if the keyed sheet cassette feeder is not locked, the transmission of the resident code and the password can be stopped.

The resident card print button 504 may be disabled subject to the key status of the keyed sheet cassette feeder determined prior to step 601 of FIG. 6.

A step for determining whether or not to quit the resident data processing may be included just in case a jam takes place in the middle of the resident data processing.

The color copying apparatus 100 thus includes a plurality of sheet storage units including a keyed sheet storage unit and a keyless sheet storage unit. When the color copying apparatus 100 performs a print process using the keyed sheet storage unit, the CPU 302 selectively switches the operational sequence depending on whether or not the keyed sheet storage unit is locked.

The control process of the CPU 302 for that switching is described with reference to FIGS. 10A–10D.

FIGS. 10A–10D show management tables 1001 stored in appropriate memory units of the color copying apparatus 100 (such as the RAM 303 or the hard disk 306). Under the control of the CPU 302, a variety of information is stored on a per sheet storage unit basis in the management table 1001. The CPU 302 performs various control processes based on data in the management table 1001.

Management information of the sheet storage unit stored in the management table 1001 includes name information for identifying the plurality of sheet storage units of the color copying apparatus 100, information upon which the CPU 302 determines the presence or absence of sheets in the sheet storage unit, and remaining sheet information on which the CPU 302 determines the remaining amount of sheets. The management information further includes open/closed status information on which the CPU 302 determines whether any sheet storage unit is opened by the user. The management information further includes keyed/keyless information from which the CPU 302 determines the keyed sheet storage unit from among the plurality of sheet storage units. If a keyed sheet storage unit is present, the management information further includes key status information from which the CPU 302 determines whether the keyed sheet storage unit is locked or unlocked. In accordance with the third embodiment, the information relating to the plurality types of sheet storage units is managed and stored on a per sheet storage unit basis. The CPU 302 effectively uses the management information when the color copying apparatus 100 performs the print process.

In response to a command from the user input to the operation unit 312, the CPU 302 controls the operation unit 312 so that the information listed in the management table 1001 is displayed on the display of the operation unit 312 in an easily recognizable manner on a per storage unit basis.

The name information, the sheet size information, and the sheet type information of the management information are information that is registered beforehand by the user of the color copying apparatus 100 through the operation unit 312. Alternatively, a sheet size sensor for detecting the sheet size for each sheet storage unit can be arranged, and the sheet size information can be acquired from the sheet size sensor. Sensors for detecting the presence or absence of sheets and the remaining sheet amount are arranged in each sheet storage unit, and the sheet presence/absence information and the remaining sheet amount information based on output information from the sensors are registered in the management table 1001. A sensor for detecting the loading and unloading of each sheet storage unit is arranged for each sheet storage unit, and the output information from the sensor is used as the open/closed status information. The keyed/keyless status information is information that is registered by the user of the color copying apparatus 100 through the operation unit 312. Based on the keyed/keyless status information, the CPU 302 determines whether any sheet storage unit is keyed or keyless. Alternatively, a memory having stored information identifying the type of sheet storage unit is arranged in each sheet storage unit, and if the sheet storage unit is mounted in the color copying apparatus 100, the CPU 302 references the information in the memory. In this way, the CPU 302 determines whether the sheet storage unit is with or without key. The key status information of whether the keyed sheet storage unit is locked or not is acquired by the CPU 302 as discussed below, for example. A key status sensor is arranged in the keyed sheet storage unit that outputs information representing the locked state if the keyed sheet storage unit is locked and information representing the unlocked state if the keyed sheet storage unit is unlocked. The CPU 302 determines the key status of the keyed sheet storage unit based on the information from the key status sensor, and sets the determination result as the management information in the management table 1001. Alternatively, the user of the color copying apparatus 100 may input key status information on the operation unit 312 so that the CPU 302 learns the status.

The CPU 302 controls the operation of the color copying apparatus 100 in response to the key status of the keyed sheet storage unit.

Even if the keyed sheet storage unit is unlocked, the use of the color copying apparatus 100 is not totally inhibited.

The following mechanism is incorporated so that the color copying apparatus 100 is used appropriately in a variety of operational environments free from the problem of the conventional art.

In accordance with the third embodiment, the color copying apparatus 100 is permitted to use the keyed sheet storage unit regardless whether the keyed sheet storage unit is locked or unlocked. To this end, the CPU 302 performs different operational sequences depending on whether the keyed sheet storage unit is locked or unlocked. The operational sequences are described below with reference to FIGS. 10A and 10B.

In the operational sequence shown in FIG. 10A, the color copying apparatus 100 includes a cassette feeder 4 and is operated with the cassette feeder 4 in the locked state thereof.

In the operational sequence shown in FIG. 10B, the color copying apparatus 100 includes the cassette feeder 4 and is operated with the cassette feeder 4 in the unlocked state thereof.

In the case of the operational sequence of FIG. 10A, the CPU 302 references the data in the management table 1001 of FIG. 10A to check that the color copying apparatus 100 includes the cassette feeder 4, and that the cassette feeder 4 is currently locked. If the cassette feeder 4 is locked, the CPU 302 identifies enabled function candidates (in an image forming mode) of the color copying apparatus 100 and causes the operation unit 312 to display a function setting screen on which the user selects a desired function from the function candidates. FIG. 5A shows the function setting screen. The screen of FIG. 5A displayed on the operation unit 312 shows a plurality of cassette feeders including the keyed cassette feeder 4 with the key thereof locked. The user selects the resident card print mode on this screen. The resident card print mode is the image forming mode in which the user enters the resident data to the color copying apparatus 100 to feed a special type sheet from the keyed cassette feeder 4 for printing. The CPU 302 permits the operation unit 312 to display the screen for the user to select the resident card print mode if the CPU 302 determines based on the management information that the keyed cassette feeder is mounted and then locked. When the user selects the resident card print mode on the screen, the color copying apparatus 100 is permitted to perform the resident card print mode.

In the case of the operational sequence of FIG. 10B, the CPU 302 references the data in the management table 1001 of FIG. 10B to check that the color copying apparatus 100 includes the cassette feeder 4, and that the cassette feeder 4 is currently unlocked. If the cassette feeder 4 is unlocked, the CPU 302 inhibits the function, expected to be performed only when with the keyed cassette feeder is locked, such as the resident card print mode, from being selected and performed. The CPU 302 identifies enabled function candidates of the color copying apparatus 100 and causes the operation unit 312 to display a function setting screen on which the user selects a desired function from the function candidates. In the case of FIG. 10B, the CPU 302 inhibits the resident card print mode from being selected and performed, and controls the operation unit 312 so that the screen of FIG. 5A to enable the user to set the resident card print mode is not displayed. The CPU 302 permits a standard copy mode to be performed. In the standard copy mode, the scanner 307 of the color copying apparatus 100 scans an original document, the data of the original document is stored in the hard disk 306, and the printer 308 prints the scanned image data on sheets. The CPU 302 causes the operation unit 312 to display a screen to enable the user to select the standard copy mode, thereby permitting the user to select and perform the copy mode on the setting screen.

In accordance with the third embodiment, the CPU 302 performs control processes, with the operation mode to permit the user to use the color copying apparatus 100 with the keyed sheet storage unit in the locked state thereof distinctively discriminated from the operation mode to permit the user to use the color copying apparatus 100 with the keyed sheet storage unit on the unlocked state thereof. The CPU 302 also controls the operation unit 312 to display the screen thereof distinctively discriminated between the locked state and the unlocked state.

When the keyed sheet storage unit is locked, the user can select a desired one from the function candidates, more specifically, select between the resident card print mode to enable the user to use the keyed sheet storage unit in the locked state thereof and the resident card print mode to enable the user to use the keyed sheet storage unit in the unlocked state thereof. When the keyed sheet storage unit is unlocked, the user cannot select the resident card print mode but can select a desired one from function candidates including the standard copy mode to permit the user to use the color copying apparatus 100 with the keyed sheet storage unit unlocked.

In accordance with the third embodiment, the color copying apparatus 100 operates even with the keyed sheet storage unit unlocked as shown in FIG. 10B. Even when the keyed sheet storage unit is unlocked, the CPU 302 permits the user to select the keyed sheet storage unit (the cassette feeder 4 in this case) so that desired image data is printed on sheets fed from the keyed sheet storage unit. When the keyed sheet storage unit is locked as shown in FIG. 10A, the CPU 302 permits the user to select the keyed sheet storage unit (cassette feeder 4) in the locked state thereof, so that desired image data is formed on sheets fed from the keyed sheet storage unit.

Even after the color copying apparatus 100 starts operating, the CPU 302 still controls the color copying apparatus 100 with the control process switched between the sequence with the keyed sheet storage unit locked and the sequence with the keyed sheet storage unit unlocked.

In the sequence of FIG. 10A, the cassette feeder 4, serving as the keyed sheet storage unit, is locked. The user selects the resident card print mode on the operation unit 312 and enters a print execution command on the operation unit 312. Under the control of the CPU 302, the color copying apparatus 100 starts operating in the resident card print mode using the cassette feeder 4. A series of print steps is now in progress.

A sheet presence/absence sensor in the cassette feeder 4 detects that no sheets are available from the cassette feeder 4 (that the cassette feeder 4 changes a sheet presence state to a sheet absence state). The CPU 302 recognizes the sheet absence state from information from the sheet presence/absence sensor in the cassette feeder 4. The color copying apparatus 100 further includes a cassette feeder 2 and a cassette feeder 3, each holding sheets of the same size and the same type as sheets of the cassette feeder 4 as shown in FIG. 10A.

The color copying apparatus 100 becomes unable to continue the print operation when sheets in the cassette feeder 4 are fully consumed. Since the color copying apparatus 100 includes the cassette feeder 2 and the cassette feeder 3, each holding the sheets of the same type and of the same size as the sheets that were held in the cassette feeder 4, the CPU 302 automatically switches from the cassette feeder 4 to one of the cassette feeders 2 and 3. The color copying apparatus 100 thus continues the print operation on the sheets fed from the selected cassette feeder without interruption (print automatic switching operation).

If no sheets are available from the cassette feeder 4 in the locked state thereof as shown in FIG. 10A, the CPU 302 inhibits the color copying apparatus 100 from performing the print automatic switching operation.

In other words, if a no-sheet-available error takes place in the keyed sheet storage unit in the locked state thereof, the CPU 302 inhibits the color copying apparatus 100 from selecting any other cassette feeder and suspends the print operation even if any other cassette feeder holds the sheet of the same size and the same type as the sheets of the cassette feeder 4.

For example, if the user selects the standard copy mode on the operation unit 312 with the cassette feeder 4 in the unlocked state thereof as shown in FIG. 10B, and inputs a copy command via the operation unit 312, the CPU 302 starts an image forming operation using the cassette feeder 4 in the standard copy mode. A series of recording steps is currently in progress.

The sheet presence/absence sensor in the cassette feeder 4 detects that no sheets are available from the cassette feeder 4 (that the cassette feeder 4 changes a sheet presence state to a sheet absence state). The CPU 302 recognizes the sheet absence state from information from the sheet presence/absence sensor in the cassette feeder 4. The color copying apparatus 100 further includes the cassette feeder 2 and the cassette feeder 3, each holding sheets of the same size and the same type as sheets of the cassette feeder 4 as shown in FIG. 10B.

When no sheets are available from the cassette feeder 4 in the unlocked state thereof as shown in FIG. 10B, the CPU 302 searches the data in the management table 1001 to determine whether any cassette feeder holding sheets of at least the same size (preferably the same size and the same type) as the sheets of the cassette feeder 4 is present. If the CPU 302 determines that a cassette feeder holding sheets of at least the same size (preferably the same size and the same type) as the sheets of the cassette feeder 4 is present, the CPU 302 automatically selects that cassette feeder to continue the print operation without interruption regardless of whether that cassette sheet feeder is keyed or keyless. The CPU 302 thus permits the color copying apparatus 100 to perform the print automatic switch function.

When a no-sheet-available error takes place in the in the keyed sheet storage unit in the unlocked state thereof during the print operation, the CPU 302 thus checks that one of the cassette feeders 2 and 3 holds the sheets of the same size and the same type as the sheets of the cassette feeder 4. The CPU 302 thus permits the color copying apparatus 100 to automatically select one of the cassette feeders 2 and 3 even if the one of the cassette feeders 2 and 3 is keyless. The color copying apparatus 100 thus continues the print operation without interruption.

As shown in FIGS. 10A and 10B, the CPU 302 controls the color copying apparatus 100 to use the keyed sheet storage unit regardless of whether the keyed sheet storage unit is locked and unlocked. However, if the keyed sheet storage unit is unlocked, the CPU 302 inhibits the color copying apparatus 100 from performing the operational sequence (also referred to as a first sequence) of printing the sheets fed from the keyed sheet storage unit in the locked state thereof. When the keyed sheet storage unit in the unlocked state thereof is used, the CPU 302 controls the color copying apparatus 100 to perform the printing sequence (discussed with reference to FIG. 10B and also referred to as a second sequence) different from the first sequence.

In this way, the CPU 302 controls the color copying apparatus 100 to selectively perform the two different sequences, namely, the first sequence and the second sequence.

In accordance with the third embodiment, the CPU 302 also performs selective control.

A no-sheet-available error now takes place while the cassette feeder 2 is used with the cassette feeder 4 in the locked state thereof. One cassette feeder holding sheets of at least the same size (preferably the same size and the same type) as sheets set in the cassette feeder that has triggered the no-sheet-available error is now present. As shown in FIG. 10A, the cassette feeder 3 as a keyless sheet storage unit and the cassette feeder 4 as a keyed sheet storage unit hold the sheets of the same size and the same type as the cassette feeder 2.

To continue the print operation without interruption, the CPU 302 automatically selects the cassette feeder 3 instead of the cassette feeder that has triggered the no-sheet-available error, thereby permitting the color copying apparatus 100 to continue the print operation on sheets fed from the cassette feeder 3. Since the color copying apparatus 100 is operated after determining that the keyed sheet storage unit is locked, the CPU 302 inhibits the color copying apparatus 100 from selecting the cassette feeder 4, thereby preventing the color copying apparatus 100 from resuming the print operation on sheets from the cassette feeder 4.

A no-sheet-available error takes place in the middle of the print operation of the color copying apparatus 100 using any of the keyless sheet storage units, such as the cassette feeder 2. The CPU 302 automatically selects a keyed sheet storage unit if that keyed sheet storage unit holds sheets of the same size and the same type as the sheets of the cassette feeder 2 (such as the cassette feeders 3 and 4 of FIG. 10A) and is keyless (the cassette feeder 3 of FIG. 10A). The CPU 302 thus permits the color copying apparatus 100 to continuously perform the print operation on the sheets from the cassette feeder 3. The CPU 302 inhibits the color copying apparatus 100 from selecting a cassette feeder if that cassette feeder is keyed while holding the sheets of the same size and the same type as the cassette feeder that has triggered the no-sheet-available error. For example, the CPU 302 inhibits the color copying apparatus 100 from performing the print operation on the sheets from the cassette feeder 4. The CPU 302 controls the color copying apparatus 100 to perform the above sequence referred to as a third sequence if the keyed sheet storage unit is locked.

A no-sheet-available error now takes place in the middle of the print operation of the color copying apparatus 100 using any of the keyless sheet storage units, such as the cassette feeder 2 with the cassette feeder 4 in the unlocked state thereof. Any cassette feeder holding sheets of at least the same size (preferably the same size and the same type) as the sheets of the cassette feeder 2 is present among the plurality of cassette feeders of the color copying apparatus 100. As shown in FIG. 10B, the cassette feeder 3 as a keyless sheet storage unit and the cassette feeder 4 as a keyed sheet storage unit hold the sheets of the same size and the same type as the cassette feeder 2.

To continue the print operation without interruption, the CPU 302 automatically selects the cassette feeder 3 instead of the cassette feeder that has triggered the no-sheet-available error, thereby permitting the color copying apparatus 100 to continue the print operation on sheets fed from the cassette feeder 3. Since the color copying apparatus 100 is operated after determining that the keyed sheet storage unit is unlocked, the CPU 302 permits the color copying apparatus 100 to select the cassette feeder 4, thereby permitting the color copying apparatus 100 to perform the print operation on sheets from the cassette feeder 4.

The no-sheet-available error takes place in the middle of the print operation of the color copying apparatus 100 using any of the keyless sheet storage units, such as the cassette feeder 2. The CPU 302 automatically selects a keyed sheet storage unit if that keyed sheet storage unit holds sheets of the same size and the same type as the sheets of the cassette feeder 2 (such as the cassette feeders 3 and 4 of FIG. 10A) and is keyless (the cassette feeder 3 of FIG. 10A). The CPU 302 thus permits the color copying apparatus 100 to continuously perform the print operation on the sheets from the cassette feeder 3. The CPU 302 permits the color copying apparatus 100 to select a cassette feeder even if that cassette feeder is keyed. For example, the CPU 302 permits the color copying apparatus 100 to perform the print operation on the sheets from the cassette feeder 4. The CPU 302 controls the color copying apparatus 100 to perform the above sequence referred to as a fourth sequence if the keyed sheet storage unit is unlocked as shown in FIG. 10B.

In this way, the CPU 302 controls the color copying apparatus 100 to selectively perform the two different sequences, namely, the third sequence and the fourth sequence.

When the keyed sheet storage unit is locked, the CPU 302 controls the color copying apparatus 100 so that the second sequence is inhibited from being performed while the first sequence is performed, and so that the fourth sequence is inhibited from being performed while the third sequence is performed. When the keyed sheet storage unit is unlocked, the CPU 302 controls the color copying apparatus 100 so that the first sequence is inhibited from being performed while the second sequence is performed, and so that the third sequence is inhibited from being performed while the fourth sequence is performed.

When an error, such as a no-sheet-available error, takes place in the middle of the print operation of the color copying apparatus 100 that uses the sheet from the keyed sheet storage unit in the locked state thereof, the first sequence is performed. In the first sequence, the CPU 302 transmits the error information from the color copying apparatus 100 to an external device, such as a remote computer operated by an administrator, to notify the administrator of the occurrence of the error. More specifically, the CPU 302 proceeds to step 903 if yes in step 902 of FIG. 9. When an error, such as a no-sheet-available error, takes place in the middle of the print operation of the color copying apparatus 100 that prints the sheet from the keyed sheet storage unit in the unlocked state thereof or from the keyless sheet storage unit, the second sequence or the fourth sequence is performed. The CPU 302 then displays, on the display of the operation unit 312, an indication that the error has occurred rather than transmitting the error information from the color copying apparatus 100 to the external device, such as a remote computer operated by the administrator. The CPU 302 further displays, on the display of the operation unit 312, an error recovery guidance to recover from the error. More specifically, the CPU 302 proceeds to step 904 if no in step 902 of FIG. 9.

The CPU 302 controls the color copying apparatus 100 in two different methods, one method for the occurrence of the error with the keyed sheet storage unit in the locked state, and the other for the occurrence of the error with the keyed sheet storage unit in the unlocked state.

The color copying apparatus 100 is thus used taking into consideration various operational environments including local e-governments, corporate offices, and convenience stores. The present invention provides a convenient system satisfying a wide range of needs of users.

When the color copying apparatus 100 is installed in a convenience store or an e-government, a service technician may set up the color copying apparatus 100 so that the print operation is performed with the keyed sheet storage unit in the locked state. The print operation of documents requiring high security level, such as the resident card containing private information, is safely performed. If an error occurs, the user can safely and quickly recover the color copying apparatus 100 from the error. In an office environment requiring no high security level, the color copying apparatus 100 may be operated with the keyed sheet storage unit left unlocked. The service technician sets the keyed sheet storage unit in an unlocked state thereof at the installation of the color copying apparatus 100. The cassette feeder 4 of FIG. 10B is used in the same manner as each of the cassette feeders 1–3 of FIG. 10B. The available cassette feeder candidates are thus increased. The color copying apparatus 100 has an easy-to-use feature. In the case of the occurrence of an error, notifying the service technician of the error is not necessary, and unnecessary exchange of information is avoided.

As shown in FIGS. 10C and 10D, the above-described control process is effectively performed if the color copying apparatus 100 includes a plurality of keyed sheet storage units. The control process of FIGS. 10C and 10D is basically identical to that already discussed with reference to FIGS. 10A and 10B. The color copying apparatus 100 performs the first sequence and the third sequence in the control process of FIG. 10C, and the second sequence and the fourth sequence in the control process of FIG. 10D.

As shown in FIG. 10C, the color copying apparatus 100 is operated with keyed cassette feeders 4 and 5 locked.

The user selects one of the resident card print mode and the standard copy mode on the operation unit 312 in the control process of FIG. 10C, and inputs a print start command via the operation unit 312. In response, the CPU 302 starts and performs printing on sheets fed from the cassette feeder 4. A no-sheet-available error now occurs. In response to the occurrence of the error, the CPU 302 references the data in the management table 1001 of FIG. 10C, checks the sheet size and the sheet type of each cassette feeder, and determines whether a keyed sheet storage unit is present.

Based on the examination result of the data in the management table 1001, the CPU 302 determines that the color copying apparatus 100 includes the keyed cassette feeder 5 holding sheets of the same size and the same type as the sheets from the cassette feeder 4 (currently having no remaining sheets), and that the keyed cassette feeder 5 is locked. The CPU 302 automatically switches from the keyed cassette feeder 4 in the locked state thereof to the keyed cassette feeder 5 in the locked state thereof to continue the print operation on the sheets from the keyed cassette feeder 5. Without interruption, the color copying apparatus 100 continues the print operation. Although the cassette feeder 2 and the cassette feeder 3 holds sheets of the same size and the same type as the sheets from the cassette feeder 4, the CPU 302 inhibits the color copying apparatus 100 from performing the print operation on the sheets from the cassette feeders 2 and 3 because these cassette feeders are keyless.

For example, a no-sheet error now occurs in the middle of the print operation of the color copying apparatus 100 that uses the cassette feeder 2. The print operation is continuously performed using a cassette feeder if that cassette feeder is keyless and holds sheets of the same size and the same type as the sheets of the cassette feeder 2.

More specifically, the CPU 302 performs a control process as below if a no-sheet-available error occurs when the cassette feeder 2 is used in the state of FIG. 10C. The CPU 302 continues the printing process using the cassette feeder 3 because the cassette feeder 3 is keyless and holds the sheets of the same size as the sheets of the cassette feeder 2. The CPU 302 inhibits the color copying apparatus 100 from continuing the print operation using the cassette feeder 1 because the cassette feeder 1 holds sheets different in sheet size from the sheets of the sheets of the cassette feeder 2. The CPU 302 inhibits the color copying apparatus 100 from continuing the print operation using the cassette feeder 5 because the keyed cassette feeders 4 and 5 are locked even though holding sheets of the same size.

The CPU 302 performs the above-described process in the status of FIG. 10C.

In the status of FIG. 10D, the color copying apparatus 100 is operated with the keyed cassette feeder 4 locked, but with the keyed cassette feeder 5 unlocked.

The user selects one of the resident card print mode and the standard copy mode on the operation unit 312 in the control process of FIG. 10D, and inputs a print start command via the operation unit 312. In response, the CPU 302 starts and performs printing on sheets fed from the cassette feeder 4. A no-sheet-available error now occurs. In response to the occurrence of the error, the CPU 302 references the data in the management table 1001 of FIG. 10D, checks the sheet size and the sheet type of each cassette feeder, and determines whether a keyed sheet storage unit is present.

Based on the examination result of the data in the management table 1001, the CPU 302 determines that the color copying apparatus 100 includes the keyed cassette feeder 5 holding sheets of the same size and the same type as the sheets from the cassette feeder 4 (currently having no remaining sheets), and that the keyed cassette feeder 5 is unlocked. The CPU 302 inhibits the color copying apparatus 100 from continuing the print operation using the keyed cassette feeder 5. If a no-sheet-available error occurs with the cassette feeder 4 in operation in the status of FIG. 10D, the CPU 302 immediately suspends the print operation. The cassette feeders 2 and 3 hold sheets of the same size as the sheets of the cassette feeder 4 but are keyless. The CPU 302 thus inhibits the color copying apparatus 100 from continuing the print operation using each of the cassette feeders 2 and 3.

For example, a no-sheet error now occurs in the middle of the print operation of the color copying apparatus 100 that currently uses the cassette feeder 2 in the status of FIG. 10D. The print operation is continuously performed using a cassette feeder if that cassette feeder holds sheets of the same size as the sheets of the cassette feeder 2 and is not a keyed cassette feeder in the locked state thereof.

More specifically, the CPU 302 performs a control process as below if a no-sheet-available error occurs when the cassette feeder 2 is used in the status of FIG. 10D. The CPU 302 continues the printing process using the cassette feeder 3 because the cassette feeder 3 is keyless and holds the sheets of the same size as the sheets of the cassette feeder 2. The CPU 302 inhibits the color copying apparatus 100 from continuing the print operation using the cassette feeder 1 because the cassette feeder 1 holds sheets different in sheet size from the sheets of the sheets of the cassette feeder 2. The CPU 302 inhibits the color copying apparatus 100 from continuing the print operation using the cassette feeder 4 because the keyed cassette feeder 4 is locked even though holding sheets of the same size. The CPU 302 permits the color copying apparatus 100 to continue the print operation using the keyed cassette feeder 5 because the keyed cassette feeder 5 is unlocked and holds sheets of the same size as the sheets of the cassette feeder 2.

The CPU 302 performs the above-described process in the status of FIG. 10D.

With a plurality of keyed sheet storage units used, the control processes discussed with reference to FIGS. 10C and 10D are performed. The color copying apparatus 100 features the ease of use and wider operational flexibility.

In the above discussion, the print operation is performed in response to the print start command entered via the operation unit 312. The present invention is not limited to this arrangement. A print start command and an image forming mode selection command may be input on an operation unit of an external device (a host computer), such as a user interface of a printer driver. The commands are then input together with image data to the color copying apparatus 100. In this arrangement, the CPU 302 performs the print operation on the sheets fed from the keyed sheet storage unit and the keyless sheet storage unit depending on the key status of the keyed sheet storage unit. When the image data is printed from the external device in this way, similar advantages are enjoyed.

Referring to a memory map of FIG. 11, the structure of a data processing program read by the image processing system of the present invention will now be discussed.

FIG. 11 illustrates the memory map of a storage medium storing a variety of data processing programs read by the image processing system of the embodiments of the present invention.

Information managing a group of programs stored in the storage medium, such as version information and producer's information, although not shown, may also be stored. Furthermore, information dependent on a program reading side OS, such as an icon identifying a program, may also be stored.

Data attached to each program is also managed in directories. If a program for installing a variety of programs onto a computer and a program to be installed onto the computer are compressed, a decompression program may also be stored.

The functions illustrated in FIGS. 6 and 9 may be executed by a host computer under the control of a program installed from the outside into the host computer. A group of pieces of information including the program is supplied to an output device from a storage medium, such as a CD-ROM, a flash memory, an FD, or via a network from an outside storage medium. Such an arrangement falls within the scope of the present invention.

A storage medium storing program codes of the software program performing the functions of the present invention is installed in a system or an apparatus, and a computer (CPU or MPU) of the system or the apparatus reads and executes the program codes stored in the storage medium. Such embodiments achieve the object of the present invention.

The program codes read from the storage medium perform the functions of the present invention, and storage medium having stored the program codes falls within the scope of the present invention.

The form of the programs is not important as long as the program performs the function thereof. The program may be an object code, a program performed by an interpreter, and script data supplied to the OS.

Available as storage media for supplying the program are a flexible disk, a hard disk, an optical disk, a magneto-optical (MO) disk, a CD-ROM, a CD-R, a CD-RW, a magnetic tape, a nonvolatile memory card, ROM, DVD and the like.

The program code read from the storage medium performs the functions of the embodiments, and the storage medium having stored the program code falls within the scope of the present invention.

A client computer is connected to a home page of the Internet using a browser of the client computer. The program of the embodiments of the present invention, or a file containing compressed program with automatic install function may be downloaded to a recording medium such as a hard disk. Program codes constituting the program of the embodiments of the present invention are divided into a plurality of files, and the files may be downloaded from respective different home pages. A WWW server and an FTP server for downloading, to a plurality of users, the program files for causing the computer to perform the process of the function of the embodiments of the present invention also fall within the scope of the present invention.

A CD-ROM having stored the computer programs of the embodiments of the present invention in an encrypted form thereof is distributed to users. Key information for decrypting the computer program is downloaded from a home page via the Internet to a user who satisfies a predetermined condition. The user decrypts the computer program with the key information and installs the computer program onto the computer.

By executing the program codes ready by the computer, the functions of the embodiments are performed. Furthermore, the operating system (OS) running on the computer performs partly or entirely a process in response to the instruction of the program code, and with the process performed, the functions of the above-referenced embodiments are performed. Such programs codes fall within the scope of the present invention.

The program codes from the storage medium are read into a memory incorporated in a feature expansion board in the computer or in a feature expansion unit connected to the computer. The CPU mounted on the feature expansion board or the feature expansion unit performs partly or entirely the actual process in response to the instruction from the program codes. The functions of the above embodiments are executed through the process. Such program codes fall within the scope of the present invention.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-395850 filed Nov. 26, 2003, and Japanese Patent Application No. 2004-294728 filed Oct. 7, 2004, each of which is hereby incorporated by reference herein.

What is claimed is:

1. An apparatus for forming an image, the apparatus comprising:

a key-lockable sheet storage unit configured to feed sheets, the key-lockable sheet storage unit having a lock status including first and second states;

a determining unit adapted to determine the lock status of the key-lockable sheet storage unit;

a controller selectively performing at least one of a first action and a second action on the key-lockable sheet storage unit based on the lock status, wherein the controller performs the first action responsive to the key-lockable sheet storage unit being in the first state, and performs the second action responsive to the key-lockable sheet storage unit being in the second state; and a keyless sheet storage unit, wherein the first action includes permitting a first print process to be performed on a sheet fed from the key-lockable sheet storage unit and inhibiting a second print process from being performed on a sheet fed from the keyless sheet storage unit, wherein the second action includes permitting the first and second print processes to be performed, and wherein the controller performs the first action responsive to the lock status being the first state and performs the second action responsive to the lock status being the second state.

2. The apparatus according to claim 1, further comprising a selecting unit allowing a user to select a first image forming mode and a second image forming mode, wherein the controller inhibits the user from selecting the first image forming mode via the selecting unit responsive to the lock status being in the second state, and permits the user to select the first image forming mode via the selecting unit responsive to the lock status being in the first state.

3. The apparatus according to claim 2, wherein the controller permits the user to select the second image forming mode via the selecting unit responsive to the lock status being at least one of the first state and the second state.

4. The apparatus according to claim 3, wherein the first image forming mode includes a print mode for printing data containing personal information, and wherein the second image forming mode includes a print mode for printing data containing no personal information.

5. The apparatus according to claim 3, wherein the first image forming mode includes a print mode having a security level higher than the second image forming mode.

6. The apparatus according to claim 3, wherein the first image forming mode includes a resident card print mode, and wherein the second image forming mode includes an image forming mode different from the resident card print mode.

7. The apparatus according to claim 3, wherein the second image forming mode includes a standard copy mode, and wherein the first image forming mode includes an image forming mode different from the standard copy mode.

8. The apparatus according to claim 1, further comprising an operation unit configured to present first and second screens, wherein the controller causes the operation unit to present the first screen responsive to the lock status being the first state, and causes the operation unit to present the second screen responsive to the lock status being the second state.

9. The apparatus according to claim 1, wherein the controller performs a first error process responsive to the lock status being the first state, and performs a second error process responsive to the lock status being the second state.

10. The apparatus according to claim 9, further comprising an operation unit, wherein the first error process includes an external notification process to notify a remote device that an error has occurred, and wherein the second error process includes a notification process to notify the operation unit that the error has occurred.

11. The apparatus according to claim 1, wherein the first state includes a locked state of the key-lockable sheet storage; and wherein the second state includes an unlocked state of the key-lockable sheet storage unit.

12. The apparatus according to claim 1, wherein image data from at least one of a scanner and an external device is printable.

13. A method for controlling an image forming apparatus having a key-lockable sheet storage unit and a keyless sheet storage unit, the method comprising:

a step of causing the image forming apparatus to perform a first action using the key-lockable sheet storage unit if a lock status of the key-lockable sheet storage unit is in a first state;

a step of causing the image forming apparatus to perform a second action using the key-lockable sheet storage unit if the lock status of the key-lockable sheet storage unit is in a second state, wherein the first action includes permitting a first print process to be performed on a sheet from the key-lockable sheet storage unit in a series of print steps while inhibiting a second print process from being performed on a sheet from the keyless sheet storage unit in the series of print steps, wherein the second action includes permitting the first print process to be performed in the series of print steps and permitting the second print process to be performed in the series of print steps, a step of causing the image forming apparatus to perform the first action in the first state; and a step of causing the image forming apparatus to perform the second action in the second state.

14. The method according to claim 13, wherein the image forming apparatus has a plurality of image forming modes including a first image forming mode and a second image forming mode, the method further comprising a step of inhibiting a user, when the key-lockable sheet storage unit is in the second state, from selecting the first image forming mode when the key-lockable sheet storage unit is in the first state, while permitting the user to select the first image forming mode.

15. The method according to claim 14, further comprising a step of permitting the user, when the key-lockable sheet storage unit is in at least one of the first state and the second state, to select the second image forming mode.

16. The method according to 15, wherein the first image forming mode includes a print mode for printing data containing personal information, and wherein the second image forming mode includes a print mode for printing data containing no personal information.

17. The method according to claim 15, wherein the first image forming mode includes a print mode having a security level higher than the second image forming mode.

18. The method according to claim 15, wherein the first image forming mode includes a resident card print mode, and wherein the second image forming mode includes an image forming mode different from the resident card print mode.

19. The method according to claim 15, wherein the second image forming mode includes a standard copy mode, and wherein the first image forming mode includes an image forming mode different from the standard copy mode.

20. The method according to claim 13, further comprising:

a step of causing an operation unit to present a first screen to enter a command to the image forming apparatus when the key-lockable sheet storage unit is the first state; and a step of causing the operation unit to present a second screen different from the first screen when the key-lockable sheet storage unit is in the second state.

21. The method according to claim 13, further comprising:

a step of causing a first error process to be performed if an error occurs in the image forming apparatus when the key-lockable sheet storage unit is in the first state; and a step of causing a second error process, different from the first error process, to be performed if an error occurs in the image forming apparatus when the key-lockable sheet storage unit is in the second state.

22. The method according to claim 21, wherein the first error processes includes an external notification process to notify a remote device, different from the image forming apparatus, that the error has occurred, and wherein the second error processes includes a notification process to notify an operation unit of the image forming apparatus that the error has occurred.

23. The method according to claim 13, wherein the first state includes a state in which the key-lockable sheet storage unit is locked, and wherein the second state includes a state in which the key-lockable sheet storage unit is unlocked.

24. The method according to claim 13, wherein image data from at least one of a scanner and an external device is printable.

25. A computer readable storage medium having stored a computer program for performing the method according to claim 13.

26. An apparatus for forming an image, the apparatus comprising:

a key-lockable sheet storage unit configured to feed sheets, the key-lockable sheet storage unit having a lock status including first and second states;

a determining unit adapted to determine the lock status of the key-lockable sheet storage unit;

a controller selectively performing at least one of a first action and a second action on the key-lockable sheet storage unit based on the lock status, wherein the controller performs the first action responsive to the key-lockable sheet storage unit being in the first state, and performs the second action responsive to the key-lockable sheet storage unit being in the second state; and a keyless sheet storage unit, wherein the first action includes inhibiting performance of a print process on a sheet fed from the keyless sheet storage unit after start of a print process on a sheet fed from the key-lockable sheet storage unit, wherein the second action includes performing the print process on the sheet fed from the keyless sheet storage unit after the start of the print process on the sheet fed from the key-lockable sheet storage unit, and wherein the controller performs the first action responsive to the lock status being the first state and performs the second action responsive to the lock status being the second state.

27. An apparatus for forming an image, the apparatus comprising:

a key-lockable sheet storage unit configured to feed sheets, the key-lockable sheet storage unit having a lock status including first and second states;

a determining unit adapted to determine the lock status of the key-lockable sheet storage unit;

a controller selectively performing at least one of a first action and a second action on the key-lockable sheet storage unit based on the lock status, wherein the controller performs the first action responsive to the key-lockable sheet storage unit being in the first state, and performs the second action responsive to the key-lockable sheet storage unit being in the second state; and a keyless sheet storage unit, wherein the first action includes inhibiting performance of a print process on a sheet fed from the key-lockable sheet storage unit after start of a print process on a sheet fed from the keyless sheet storage unit, wherein the second action includes performing the print process on the sheet fed from the key-lockable sheet storage unit after the start of the print process on the sheet fed from the keyless sheet storage unit, and wherein the controller performs the first action responsive to the lock status being the first state and performs the second action responsive to the lock status being the second state.

28. A method for controlling an image forming apparatus having a key-lockable sheet storage unit and a keyless sheet storage unit, the method comprising:

a step of causing the image forming apparatus to perform a first action using the key-lockable sheet storage unit if a lock status of the key-lockable sheet storage unit is in a first state;

a step of causing the image forming apparatus to perform a second action using the key-lockable sheet storage unit if the lock status of the key-lockable sheet storage unit is in a second state, wherein the first action includes inhibiting the image forming apparatus from performing a print process on a sheet from the keyless sheet storage unit in succession to start of a print process on a sheet from the key-lockable sheet storage unit, wherein the second action includes permitting the image forming apparatus to perform a print process on the sheet from the keyless sheet storage unit in succession to the start of the print process on the sheet from the key-lockable sheet storage unit, a step of causing the image forming apparatus to perform the first action in the first state; and a step of causing the image forming apparatus to perform the second action in the second state.

29. A computer readable storage medium having stored a computer program for performing the method according to claim 28.

30. A method for controlling an image forming apparatus having a key-lockable sheet storage unit and a keyless sheet storage unit, the method comprising:

a step of causing the image forming apparatus to perform a first action using the key-lockable sheet storage unit if a lock status of the key-lockable sheet storage unit is in a first state;

a step of causing the image forming apparatus to perform a second action using the key-lockable sheet storage unit if the lock status of the key-lockable sheet storage unit is in a second state, wherein the first action includes inhibiting the image forming apparatus from performing a print process on a sheet from the key-lockable sheet storage unit in succession to start of a print process on a sheet from the keyless sheet storage unit, wherein the second action includes permitting the image forming apparatus to perform a print process on the sheet from the key-lockable sheet storage unit in succession to the start of the print process on the sheet from the keyless sheet storage unit, a step of causing the image forming apparatus to perform the first action in the first state; and a step of causing the image forming apparatus to perform the second action in the second state.

31. A computer readable storage medium having stored a computer program for performing the method according to claim 30.

* * * * *